United States Patent [19]

Bills

[11] 4,073,517

[45] Feb. 14, 1978

[54] LOCK FOR SLIDING DOORS

[76] Inventor: Marius W. Bills, 16220 Schoolcraft, Detroit, Mich. 48227

[21] Appl. No.: 774,458

[22] Filed: Mar. 4, 1977

Related U.S. Application Data

[63] Continuation of Ser. No. 618,620, Oct. 1, 1975, abandoned.

[51] Int. Cl.[2] ..... E05C 5/02

[52] U.S. Cl. ..... 292/60; 292/DIG. 46

[58] Field of Search ..... 292/57, 58, 59, 60, 292/61, DIG. 20, DIG. 46, DIG. 47; 70/466

[56] References Cited

U.S. PATENT DOCUMENTS

| | | | |
|---|---|---|---|
| 725,662 | 4/1903 | Bohlen | 292/60 |
| 1,083,455 | 1/1914 | Mohn | 292/57 |
| 1,815,422 | 7/1931 | Songey | 292/60 |
| 3,779,588 | 12/1973 | Reymon | 292/57 |
| 3,854,312 | 12/1974 | Van Gompel | 292/60 X |

*Primary Examiner*—Robert L. Wolfe

*Attorney, Agent, or Firm*—Barnes, Kisselle, Raisch & Choate

[57] ABSTRACT

A lock for sliding doors including a first door and a second door slidable with respect to a second door. The lock is mounted on the second door and has a housing engaging the side surface of the frame of said second door. The housing has an inner wall adjacent the frame of the first door, an outer wall and an intermediate wall between the inner and outer walls. A plunger is slidable in openings in the outer, intermediate and inner walls. Spring means yieldingly urge the plunger outwardly. The opening in the outer wall has a noncircular configuration, the opening in said intermediate wall has a similar configuration but circumferentially oriented with respect to the opening in said outer wall, and the shaft has a laterally extending projection corresponding to the configuration of the openings in said inner and outer wall. The first door has an opening therein into which the plunger extends such that the plunger can be held outwardly out of locking position by moving the shaft and rotating the same so that the projection thereon moves through the opening in the intermediate wall and the opening in the outer wall and engages the outer surface of the outer wall and the lock may be engaged by rotating the shaft such that the projection thereon permits movement of the shaft under the action of the spring means through the opening in the outer wall and thereafter further rotation of the shaft permits movement of the shaft and the projection thereon through the opening in the intermediate wall so that the shaft engages the opening in the first door and is held against movement axially outwardly by engagement of the projection thereon with the inner surface of the intermediate wall.

14 Claims, 10 Drawing Figures

LOCK FOR SLIDING DOORS

This is a continuation of application Ser. No. 618,620, filed Oct. 1, 1975 and now abandoned.

This invention relates to sliding doors and particularly to locks for sliding doors.

BACKGROUND OF THE INVENTION

In sliding doors for homes and the like, it is common to provide a hand-manipulated latch as a lock. However, such a latch does not provide sufficient security and, therefore, it has heretofore been suggested that other auxiliary locks be provided.

Among the objects of the invention are to provide a lock for sliding doors which is low in cost, easy to manufacture, easily installed, effectively locks the sliding door, prevents the sliding door from being lifted from its track, and is subject to minimal tampering.

SUMMARY OF THE INVENTION

In accordance with the invention, the lock comprises a housing engaging the side surface of the frame of the sliding door. The housing has an inner wall adjacent the frame of the sliding door, an outer wall and an intermediate wall between the inner and outer walls. A plunger is slidable through openings in the outer, intermediate and inner walls. Spring means yieldingly urge the plunger outwardly. The opening in the outer wall has a noncircular configuration, the opening in said intermediate wall has a similar configuration but circumferentially oriented with respect to the opening in said outer wall, and the shaft has a laterally extending projection corresponding to the configuration of the openings in said inner and outer wall. The other door has an opening therein into which the plunger extends such that the plunger can be held outwardly out of locking position by moving the shaft and rotating the same so that the projection thereon moves through the opening in the intermediate wall and the opening in the outer wall engages the outer surface of the outer wall and the lock may be engaged by rotating the shaft such that the projection thereon permits movement of the shaft under the action of the spring means through the opening in the outer wall and thereafter further rotation of the shaft permits movement of the shaft and the projection thereon through the opening in the intermediate wall so that the shaft engages the opening in the other door and is held against movement axially outwardly by engagement of the projection thereon with the inner surface of the intermediate wall.

DESCRIPTION

Figure 1:
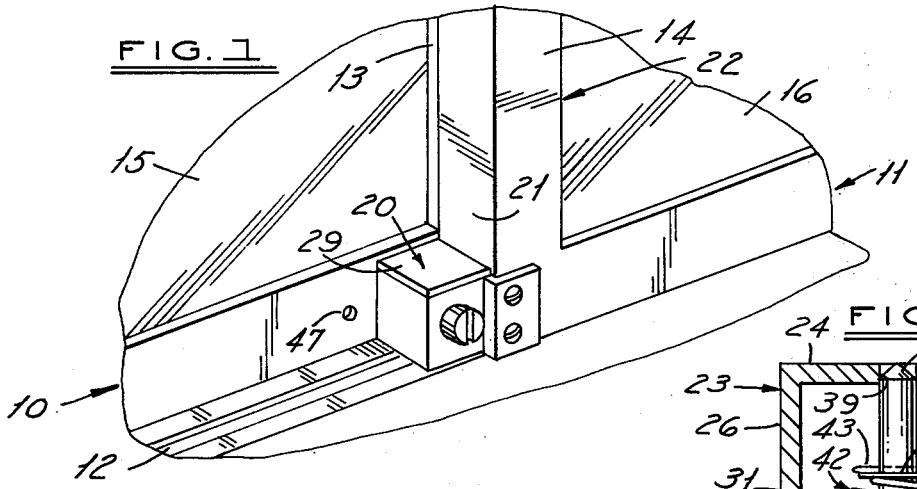
FIG. 1 is a fragmentary perspective view of a sliding door construction embodying the invention.

Referring to FIG. 1, the invention relates to sliding doors such as an arrangement wherein a first sliding door 10 which may be stationary and a second sliding door 11 is movable along a track 12. The sliding doors 10, 11 conventionally comprise a frame 13, 14 and a glass sheet 15, 16 mounted in the frames 13, 14. In accordance with the invention, the lock 20 is mounted on the side surface 21 of the side member 22 of the frame 14 and comprises a housing 23 that is made in the form of an aluminum extrusion defining an inner wall 24, an outer wall 25 and side walls 26, 27. The extrusion further includes an integral, laterally extending flange 28. The housing further includes a top wall 29 and a bottom wall 30 which are fixed on the top and bottom of wall 24–27 by suitable means such as an adhesive.

The lock further includes an intermediate wall 31 that is slidably engaged with ribs 32, 33 that are extruded on the side walls 26, 27. In addition, a reinforcing steel wall 34 slidably engages the ribs 33 and the inner surface 35 of the outer wall 25.

A plunger or shaft 36 extends through openings 37, 38, 39 in the outer wall 25, intermediate wall 31 and inner wall 24, respectively. The opening 37 in the outer wall is key shaped and includes lateral radial portions 40. The opening 38 in the intermediate wall 31 has a similar configuration with the radial portions thereof extending at a right angle to the portions 40 of opening 37. The opening in the inner wall 24 is circular to conform to the outer configuration of the shaft 36.

The plunger 36 includes a transverse pin 41 that has substantially the same dimensions as the portions 40 of opening 37. A spring 42 is interposed between the inner surface of the inner wall 24 and the opposed surface of the intermediate wall 31. The spring 42 is generally conically shaped with the smaller diameter adjacent the wall 31 and has a smaller loop at its upper end engaging a cotter pin 43 extending through the shaft. The shaft includes a knob 44 at its outer end and a tapered point 45 at its inner end. The frame 13 of the first wall 10 is formed with openings 46, 47 which are adapted to be engaged by the shaft 36. Washers **42*a*, 42*b* are interposed between the cotter pin 43 and transverse pin 41** to minimize wear on the ends of the springs.

The lock is mounted on the sliding door 11 by a screw 48 extending through the side walls into the side wall 21 of the frame 14 and by screws 49 extending through openings in the flange 28 into the outer wall of the frame 14. Screw 48 has a hex head and is applied when the lock is placed in position and held by the screws 49 before the cover 29 is mounted. The cover 29 is then mounted and fixed in position as for example by use of an adhesive. The length of the screws 49 is such that they extend for a distance behind the wall 27 further strengthening the wall against any action that would tend to pry the lock away from the door 11.

Figure 3:
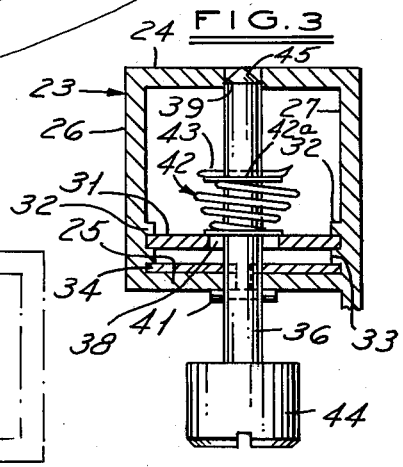
FIG. 3 is a view similar to FIG. 2 showing the parts in a different operative position.

Referring to FIG. 3, when the lock is disengaged, the plunger 36 is retracted with the cross pin or projections 41 engaging the outer surface of the outer wall 25. When it is desired to engage the lock, the knob 44 is grasped and the shaft 36 is rotated to bring the pin 41 into alignment with the portions 40 of the opening 37 so that the spring 42 will force the plunger inwardly. This will bring the pin 41 into engagement with the outer surface of the intermediate wall 31. The knob is further rotated to bring the pin 41 into alignment with the opening 38 in intermediate plate 31 to carry the shaft 36 further inwardly; and finally the knob is rotated to bring the pin 41 so that it is no longer aligned with the opening 38, thereby locking the shaft 36 in position in either opening 46, if the sliding door 11 is to be fully closed, or in opening 47, if the sliding door is to be locked in partly open position.

In order to unlock the door, the reverse procedure is followed in grasping and rotating the knob 44.

Figure 2:
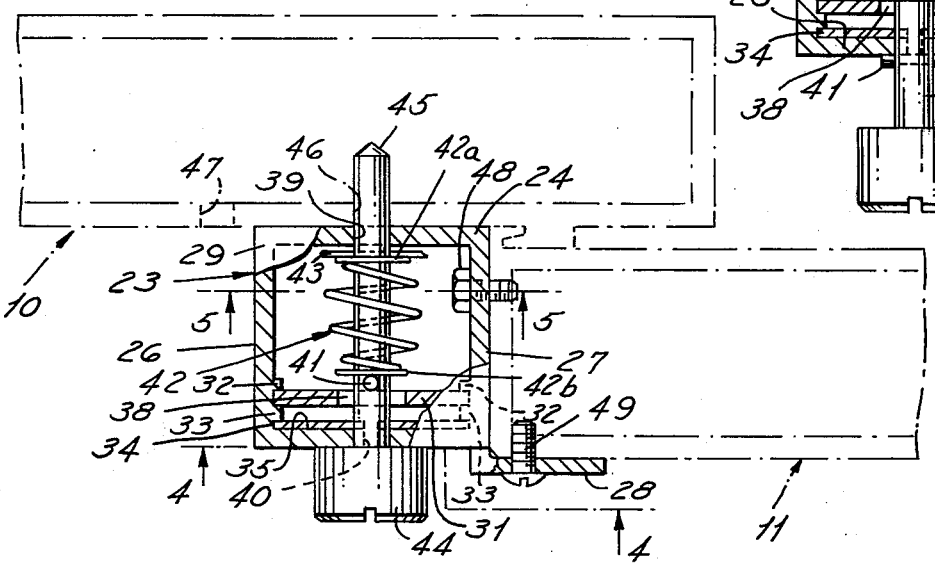
FIG. 2 is a horizontal sectional view through the same, parts being broken away.
Figure 4:
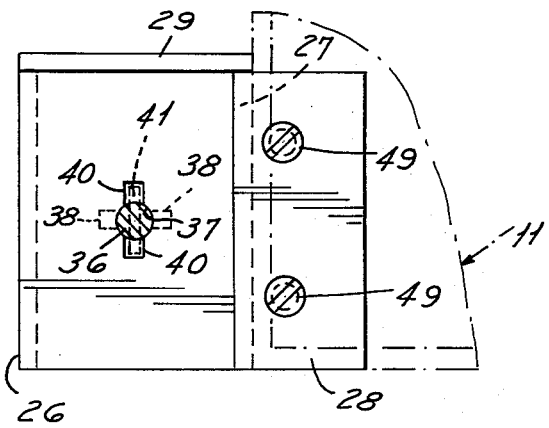
FIG. 4 is a sectional view taken along the line 4—4 in FIG. 2.
Figure 5:
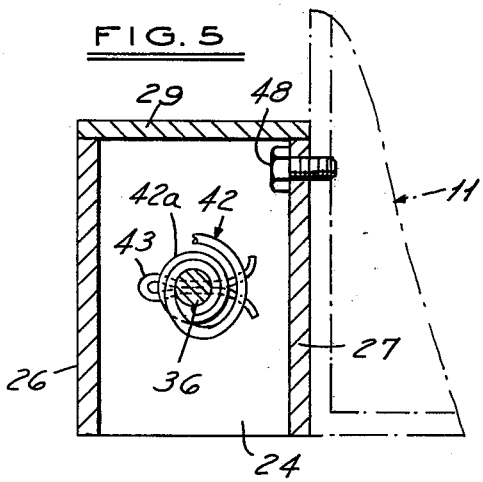
FIG. 5 is a sectional view taken along the line 5—5 in FIG. 2.
Figure 6:
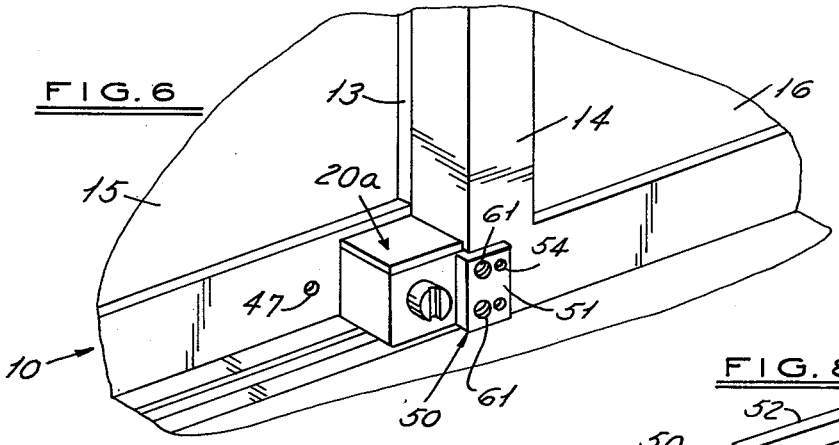
FIG. 6 is a fragmentary perspective view of a sliding door embodying a modified form of the invention.
Figure 8:
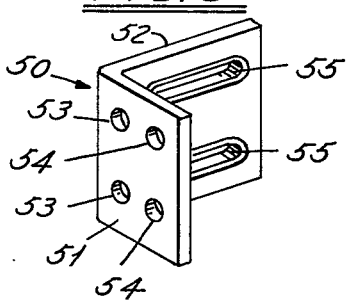
FIG. 8 is a perspective view of a part of the lock.

Provision of the point 45 on the end of the shaft 36 is intended to prevent tampering and forcing of the plunger axially outwardly by engagement of a tool or drill with the end of the shaft 36 from the exterior of the building. Any tool forced axially toward the plunger from the direction of the arrow in FIG. 2 will be deflected by the taper and tampering thereby will be thwarted.

If the knob 44 is manipulated only sufficiently to move the transverse pin 41 into the space between the walls 25, 31, the shaft will effectively be locked against outward movement by the wall 25. In this position, any action by an intruder tending to push the shaft 36 inwardly will be only sufficient to press the shaft so that the pin 41 engages the reinforcing plate 35, but the end of the plunger 36 will still be maintained in engagement with the opening 46.

The modified form of construction shown in FIGS. 6–10 is directed to the problem of adapting a lock, such as that previously described which has a plunger for engaging the other door, to situations wherein the doors vary in thickness. In describing this form of the invention, similar reference numerals are utilized wherever possible. In this form of the invention, the flange 28 is not made as an integral part of the housing. Instead a bracket 50 having two angularly related walls 51, 52 is provided. The wall 51 has vertical rows of openings 53, 54 and the wall 52 has horizontally elongated openings 55.

The bracket 50 is mounted on the lock **20*a* by screws 59, 60 extending through the elongated slots 55 into openings in the wall 27*a* of lock 20*a*. The ends of the screws 59, 60 are beveled to engage the beveled sides of the openings 55 and flat to be flush with the outer surface of the wall 52. With the lock so mounted on the bracket 50, the assembly of the bracket and lock are then brought into position adjacent the door 11 with the outer surface of the wall 52 engaging the end of the door 11 and the inner surface of the wall 51 engaging the outer surface of the door 11. Screws 61 are then provided through openings 53 and a hex headed screw 57 is provided through openings in the wall 27*a* and the end wall of the sliding door 11** to fasten the lock in position.

Figure 7:
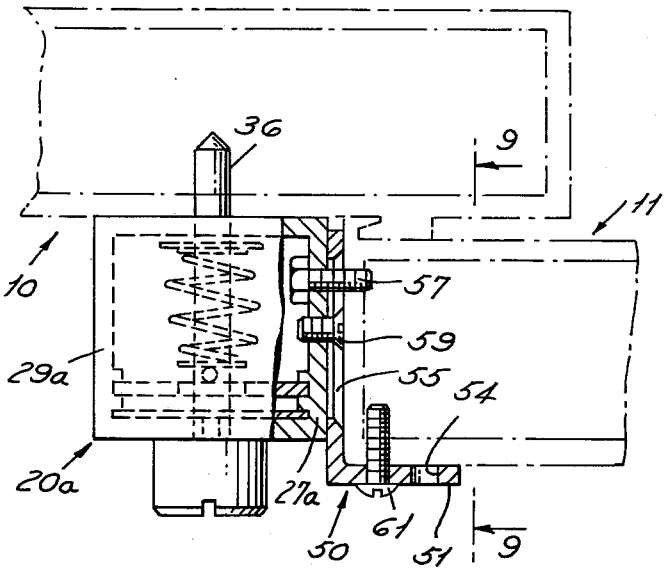
FIG. 7 is a horizontal sectional view of the same, parts being broken away.
Figure 9:
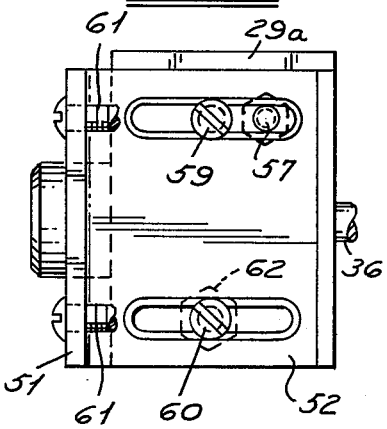
FIG. 9 is a view taken along the line 9—9 in FIG. 10.

As shown in FIGS. 7 and 9, screw 59 is dimensioned so that it does not project beyond the inner surface of wall **27*a* in order that access may be readily had to the screw 57 to permit the screw to be tightened. The lower screw 60 is of longer length and preferably provided with a nut 62**.

Figure 10:
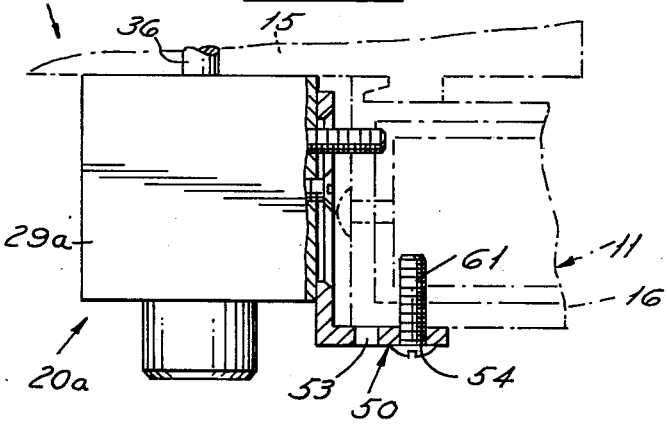
FIG. 10 is a view similar to FIG. 7 showing the lock on a door of different size.

As shown in FIG. 10, the lock **20*a* may be mounted on a door 11*a* having a greater width by changing the position of the wall 52 of bracket 50 with respect to the lock and utilizing the openings 54 instead of the openings 53 for the screws 61**.

As will be apparent to a person skilled in the art, a reversal of the preferred form of the invention shown in FIGS. 1–5 can be obtained by providing a single key way in the outer wall 25 and two angularly related and longitudinally spaced pins on the shaft 36 although the form shown in FIGS. 1–5 produces preferred results.

I claim:

1. In a sliding door, the combination comprising a first door having a frame with a side surface and a front surface, a second sliding door having a frame, a lock mounted on said frame of said second door, said lock having a housing engaging the side surface of the frame of said second door, said housing having an inner wall adjacent the frame of the first door and an outer wall, an intermediate wall between said inner and outer walls, said intermediate wall being positioned closely adjacent said outer wall to define a space between said intermediate wall and outer wall, a plunger, said outer, intermediate and inner walls having aligned openings therein through which the plunger extends, means yieldingly urging the plunger inwardly, the opening in the outer wall having a noncircular configuration, the opening in said intermediate wall having a substantially similar configuration but circumferentially oriented with respect to the opening in said outer wall, said plunger having a laterally extending projection along a portion of the length thereof corresponding substantially to the configuration of the openings in said inner and outer wall, the axial distance between the outer wall and the intermediate wall being substantially equal to the axial length of the laterally extending projection on said plunger, said first door having an opening therein into which the plunger is adapted to extend, such that the plunger may be held outwardly out of locking position by moving the plunger and rotating the same so that the projection thereon moves through the opening in the intermediate wall and the opening in the outer wall and engages the outer surface of the outer wall and the lock may be engaged by rotating the plunger such that the projection is aligned with the opening in the outer wall permitting movement of the plunger under the action of the spring means through the opening in the outer wall and thereafter further rotation of the plunger brings the projection into alignment with the opening in the intermediate wall to permit movement of the plunger and the projection thereon through the opening in the intermediate wall so that the plunger engages the opening in the first door and further rotation moves the projection on the plunger so that the plunger is held against movement axially outwardly by engagement of the projection thereon with the inner surface of the intermediate wall, the distance between said projection and the end of said plunger being greater than the distance from the space between said intermediate wall and outer wall to the inner wall such that when said plunger is in position with said projection in the space between the intermediate wall and outer wall, the end of said plunger extends beyond said inner wall and is in engagement with the opening in the first door.

2. The combination set forth in claim 1 wherein said shaft has a tapered point.

3. The combination set forth in claim 1 including a reinforcing plate interposed between said intermediate wall and said outer wall and having an opening therein aligned with and having substantially the same configuration as the opening in the outer wall.

4. The combination set forth in claim 1 wherein said housing comprises an extrusion with side walls formed integrally with the inner and outer end walls, said extrusion having spaced ribs, said intermediate wall being formed by a plate slidably engaging said spaced ribs.

5. The combination set forth in claim 4 including a reinforcing plate slidably engaging opposed ribs on said side walls of said extrusion and in contact with the inner surface of the outer wall.

6. In a lock for sliding doors, a housing having an inner wall adapted to be mounted on one door adjacent the frame of the other door and having an outer wall, an intermediate wall between said inner and outer walls, a plunger, said outer, intermediate and inner walls having aligned openings therein through which the plunger extends, means yieldingly urging the plunger inwardly, the opening in the outer wall having a noncircular configuration, the opening in said intermediate wall having a substantially similar configuration but circumferentially oriented with respect to the opening in said outer wall, said plunger having a laterally extending projection along a portion of the length thereof corresponding substantially to the configuration of the openings in said inner and outer wall, the axial distance between the outer wall and the intermediate wall being substantially equal to the axial length of the laterally extending projection on said plunger, such that the plunger may be held outwardly out of locking position by moving the plunger and rotating the same so that the projection thereon moves through the opening in the intermediate wall and the opening in the outer wall and engages the outer surface of the outer wall and the lock may be engaged by rotating the plunger such that the projection is aligned with the opening in the outer wall permitting movement of the plunger under the action of the spring means through the opening in the outer wall and thereafter further rotation of the plunger brings the projection into alignment with the opening in the intermediate wall permitting movement of the plunger and the projection thereon through the opening in the intermediate wall so that the plunger may engage the opening in a door and further rotation moves the projection on the plunger so that the plunger is held against movement axially outwardly by engagement of the projection thereon with the inner surface of the intermediate wall, the distance between said projection and the end of said plunger being greater than the distance from the space between said intermediate wall and outer wall to the inner wall such that when said plunger is in position with said projection in the space between the intermediate wall and outer wall, the end of said plunger extends beyond said inner wall.

7. The combination set forth in claim 6 wherein said shaft has a tapered point.

8. The combination set forth in claim 6 including a reinforcing plate interposed between said intermediate wall and said outer wall and having an opening therein aligned with and having substantially the same configuration as the opening in the outer wall.

9. The combination set forth in claim 6 wherein said housing comprises an extrusion with integral side walls formed integrally with the inner and outer end wall, said extrusion having spaced ribs, said intermediate wall being formed by a plate slidably engaging said spaced ribs.

10. The combination set forth in claim 9 including a reinforcing plate slidably engaging opposed ribs on said side walls of said extrusion and in contact with the inner surface of the outer wall.

11. In a lock for sliding doors, a housing comprising a tubular extrusion having an inner wall adapted to be mounted adjacent the frame of a sliding door and having an outer wall and side walls, said side walls having spaced ribs thereon, an intermediate wall slidingly engaging said ribs, said intermediate wall being positioned closely adjacent said outer wall to define a space between said intermediate wall and outer wall, top and bottom walls closing said housing, a plunger, said outer, intermediate and inner walls having aligned openings therein through which the plunger extends, means yieldingly urging the plunger inwardly, the opening in the outer wall having a non-circular configuration, the opening in said intermediate wall having a substantially similar configuration but circumferentially oriented with respect to the opening in said outer wall, said plunger having a laterally extending projection along a portion of the length thereof corresponding substantially to the configuration of the openings in said inner and outer wall, the axial distance between the outer wall and the intermediate wall being substantially equal to the axial length of the laterally extending projection on said plunger, said first door having an opening therein into which the plunger is adapted to extend, such that the plunger may be held outwardly out of locking position by moving the plunger and rotating the same so that the projection thereon moves through the opening in the intermediate wall and the opening in the outer wall and engages the outer surface of the outer wall and the lock may be engaged by rotating the plunger such that the projection is aligned with the opening in the outer wall permitting movement of the plunger under the action of the spring means through the opening in the outer wall and thereafter further rotation of the plunger brings the projection into alignment with the opening in the intermediate wall permitting movement of the shaft and the projection thereon through the opening in the intermediate wall so that the shaft engages the opening in a door and further rotation moves the projection on the plunger so that the plunger is held against movement axially outwardly by engagement of the projection thereon with the inner surface of the intermediate wall, the distance between said projection and the end of said plunger being greater than the distance from the space between said intermediate wall and outer wall to the inner wall such that when said plunger is in position with said projection in the space between the intermediate wall and outer wall, the end of said plunger extends beyond said inner wall.

12. The combination set forth in claim 11 wherein said shaft has a tapered point.

13. The combination set forth in claim 11 including a reinforcing plate slidably engaging opposed ribs on said side walls of said extrusion and in contact with the inner surface of the outer wall.

14. In a sliding door, the combination comprising a first door having a frame with a side surface and a front surface, a second sliding door having a frame, a lock mounted on said frame of said second door, said lock having a housing engaging the side surface of the frame of said second door, said housing having an inner wall adjacent the frame of the first door and an outer wall, an intermediate wall between said inner and outer walls, said intermediate wall being positioned closely adjacent said outer wall to define a space between said intermediate wall and outer wall, a plunger, said outer, intermediate and inner walls having aligned openings therein through which the plunger extends, the openings in the outer wall having a non-circular configuration, the opening in said intermediate wall having a substantially similar configuration but circumferentially oriented with respect to the opening in said outer wall, said plunger having a laterally extending projection along a portion of the length thereof corresponding substantially to the configuration of the openings in said inner and outer wall, the axial distance between the outer wall and the intermediate wall being substantially equal to the axial length of the laterally extending projection on said plunger, said first door having an opening therein into which the plunger is adapted to extend, such that the plunger may be held outwardly out of locking position by moving the plunger and rotating the same so that the projection thereon moves through the opening in the intermediate wall and the opening in the outer wall and engages the outer surface of the outer wall and the lock may be engaged by rotating the plunger such that the projection is aligned with the opening in the outer wall permitting movement of the plunger through the opening in the outer wall and thereafter further rotation of the plunger brings the projection into alignment with the opening in the intermediate wall to permit movement of the plunger and the projection thereon through the opening in the intermediate wall so that the plunger engages the opening in the first door and further rotation moves the projection on the plunger so that the plunger is held against movement axially outwardly by engagement of the projection thereon with the inner surface of the intermediate wall, the distance between said projection and the end of said plunger being greater than the distance from the space between said intermediate wall and outer wall to the inner wall such that when said plunger is in position with said projection in the space between the intermediate wall and outer wall, the end of said plunger extends beyond said inner wall and is in engagement with the opening in the first door.

* * * * *